US005798185A

United States Patent [19]

Kato

[11] Patent Number: 5,798,185

[45] Date of Patent: Aug. 25, 1998

[54] JOINED STRUCTURE AND JOINING METHOD OF METAL PLATES

[75] Inventor: Akira Kato, Nagoya, Japan

[73] Assignee: Sanyo Machine Works, Ltd., Aichi, Japan

[21] Appl. No.: 507,298

[22] PCT Filed: Oct. 6, 1994

[86] PCT No.: PCT/JP94/01679

§ 371 Date: Oct. 11, 1995

§ 102(e) Date: Oct. 11, 1995

[87] PCT Pub. No.: WO95/17983

PCT Pub. Date: Jul. 6, 1993

[30] Foreign Application Priority Data

Dec. 27, 1993 [JP] Japan ..... 5-331147
Mar. 29, 1994 [JP] Japan ..... 6-058479

[51] Int. Cl.[6] ..... B21D 39/00; B21D 5/00; B21D 5/16; B21C 37/00

[52] U.S. Cl. ..... 428/582; 428/594; 428/595; 428/621; 29/432; 29/458

[58] Field of Search ..... 29/17.1, 17.2, 29/17.3, 17.4, 432, 432.1, 432.2, 428, 458, 465, 525; 428/544, 582, 594, 595, 621

[56] References Cited

U.S. PATENT DOCUMENTS

Re. 31,737 11/1984 Hafner ..... 29/432.2
3,757,830 9/1973 Anderson et al. ..... 138/163
3,981,064 9/1976 Hafner ..... 29/432
4,658,502 4/1987 Eckold et al. ..... 29/798
4,750,301 6/1988 Croxford ..... 52/58
5,027,503 7/1991 Sawdon ..... 29/798
5,237,734 8/1993 Polon ..... 29/513

FOREIGN PATENT DOCUMENTS 1310227 10/1962 France .
2216035 8/1974 France .

OTHER PUBLICATIONS

Patent Abstracts of Japan, vol. 7, No. 63 (M-200) [1208], Mar. 16, 1983 & JP-A-57 206533, Dec. 17, 1982.

Patent Abstracts of Japan, vol. 15, No. 465(E-1138) [4993], Nov. 26, 1991 & JP-A-03 201498, Sep. 3, 1991.

*Primary Examiner*—John J. Zimmerman
*Assistant Examiner*—Michael LaVilla
*Attorney, Agent, or Firm*—Nikaido, Marmelstein, Murray & Oram LLP

[57] ABSTRACT

Two metal plates are joined together by curling, where projections are formed in advance at an edge of one of the two metal plates and those projections are forcibly advanced into an edge or the other of the two metal plates so as to interlock the metal plates without any mutual displacement therebetween and not requiring any positioning of projections or cut and raised portions with respect to holes.

3 Claims, 6 Drawing Sheets

JOINED STRUCTURE AND JOINING METHOD OF METAL PLATES

This application has been filed under 35 U.S.C. 371, claiming priority from PCT/JP94/01679 filed on 6 Oct. 1994.

TECHNICAL FIELD

The present invention relates to a joined structure and a joining method of metal plates. To explain it with examples, this invention can be utilized for joining a front panel having opening which is a structural member of a cooking apparatus with a cylindrical shell plate serving as inner case, joining in sheet metal structures of an automobile, etc.

BACKGROUND ART

Cooking apparatus (1) such as a microwave oven, oven, etc. is composed of main body (2) and door (3) as shown in FIG. 2 (A). The main body (2) is provided with an inner case (4) to make effective use of heat and prevent leakage of electric waves.

The inner case (4) is constructed with front panel (5), shell (6) and rear panel (8) as shown in FIG. 2 (B). The shell (6) has a cylindrical structure and is composed of top plate (9) and shell plate (10) with U-shaped section. The front panel (5) is provided with an opening (7) to enable putting in and taking out of object material for cooking.

The shell (6) and the front panel (5) are joined into an integral structure by caulking popularly known as curling at the front edge of the shell p)ate (10), the front edge of the top plate (9) and the periphery (7A) of the opening (7) (see JP-U-59-41444).

In the opening (7) of the front panel (5), a folded part (7B) is formed on the entire circumference in preparation for curling. Moreover, at the front edges of the top and shell plates (9,10) constituting the shell (6), folded parts (9B, 10B) are formed, respectively, as joining means corresponding to the folded part (7B) on the front panel (5) side.

The joining of the front panel (5) and the front edge of the shell (6) into an integral body is performed by putting the folded part (7B) on the front panel (5) side and the folded parts (9B, 10B) on the shell (6) side one upon the other and applying a load P in the direction X, as shown in FIG. 3 (A).

As it is understood from FIG. 3 (A), the respective folded parts (7B, 9B, 10B) form a solid joined structure not producing any deviation in their mutual joining positions even when the circumference of opening (7A) of the front panel (5) is pulled in the direction Y or when the front edge (9B) of the top plate (9) or the front edge (10B) of the shell plate (10) is pulled in the direction Y', by having their respective tip parts held inside the folded part of their counterparts.

However, when, in the joined structure as shown in FIG. 3 (A), a tensile load in the direction opposite to above acts, i.e., if the circumference of opening (7A) of the front panel (5) is pulled in the direction Y' or the front edge (9B or 10B) of the top plate (9) or the shell plate (10) is pulled in the direction Y, the joined structure loses its joining strength, producing a mutual displacement among the front panel (5), the top plate (9) and the shell plate (10) because no fastening means is provided in the direction of movement of the respective folded parts (7B, 9B, 10B).

Therefore, the joining system by curling shown in FIG. 3 (A) could not provide any joined structure capable of demonstrating a solid joining strength in all directions.

To solve such problem, in the prior art according to JP-U-58-41411, JP-A-59-119118, JP-Y-1-38418, etc. form, in a heating chamber of a microwave oven constructed by caulking the inner case (4) and the front panel (5), in which, as shown in FIG. 3(B), a plural number of projections (11) are formed at prescribed intervals on one of the inner case (4) and the front panel (5), e.g. on the front panel (5) and a plural number of holes (12) are formed at the same intervals as those of the projections (11) on the other, e.g. in the top plate (9) and the shell plate (10), so that the projections (11) are received in the holes (12) as a result of curling, thereby preventing separation of the inner case (4) from the front panel (5).

In the prior art as shown in FIG. 3 (C), cut and raised portion, or tongues (11A) are provided at prescribed interval in the circumference of opening (7A) of the front panel (5) as substitute member for a plural number of small projections (11). The tongues (11A) advance in the holes (12) at the time of curling, and thus the inner case (4) and the front panel (5) are joined into an integral structure.

In the prior art described above, it is necessary for the every projection (11) or tongue (11A) advances in the hole (12), and any deviation at a single point in the positional relation between the projections (11) or tongues (11A) and the holes (12) makes curling impossible. For that reason, it is indispensable to accurately position all the projections (11) or tongues (11A) with respect to the holes (12).

However, this positioning, which is a very troublesome work, not only put an obstacle to labor saving but also presented a great restriction to the maintenance of the working accuracy.

Moreover, in the prior art described above, it was necessary to make the size of the projections (11) or tongues (11A) somewhat smaller than that of the holes (12) to facilitate advancement of the projections (11) or tongues (11A) into the holes (12). As a result, there was a problem, after the completion of curling, of a gap produced between the projections (11) or tongues (11A) and the holes (12) or, in the case of a weak tightening load P, a problem of displacement of projections (11) or tongues (11A), thereby causing a play between the inner case (4) and the front panel (5).

DISCLOSURE OF THE INVENTION

As means for solving the above-mentioned problems, the present invention puts a first metal plate having an edge folded at an acute angle and a second metal plate having an edge folded at an acute angle one upon the other in such a way that the edges face in opposite directions and provide projections at the edge or one of the first and second metal plates, so that the projections may be forcibly pushed into the edge of the other of the first and second metal plates at the time of press-bending the edges.

Projections may be provided at the edge of one of the metal plates only, or alternatively, the respective edge of the both metal plates have such projection with locations thereof displaced.

When the edges are subjected to bending load, the metal plate not having projections at its edge may preferably by means of a jig having recesses at the positions corresponding to the projections.

Moreover, the present invention provides an integral structure of the two metal plates joined by placing them one upon the other so that edges being a part of the respective metal plates and bent at acute angles oppose each other and applying a load onto the opposing edges, wherein projections are formed on a surface of the edge of one of the metal plates and are forcibly pushed into the edge of the other metal plate.

In the case where an insulating film is formed on a surface of the other metal plate, the insulating film is broken at the tip of the projections when the projections are forcibly pushed in. Thus, the present invention provides an integral structure in which the film on the other metal plate is partially broken by the projections.

The projections provided at the edge of one metal plate are forcibly pushed into the edge of the other metal plate by plastically deforming the edge of the latter. As a result, the projections provided at the edge of one metal plate and the edge portion of the other metal plate plastically deformed along those projections engage well with each other and constitute a solid positioning means.

Consequently, in a joined structure composed of the first and second metal plates joined this way, any displacement can be prevented securely. And yet, because the edge part not having any projections is flat and that the projections are pushed in there, the joining work is easy without requiring any troublesome positioning.

By supporting the metal plate not having any projections at its edge with a jig having recessed formed at positions corresponding to the projections, the plastic deformation of the edge in which the projections are pushed in can be made smoothly.

Moreover, even in the case where an insulating film exists on the surface of the mating metal plate, this insulating film is broken when the projections are forcibly pushed in and, as a result, a joined structure securing electric continuity between metal plates can be obtained.

BRIEF DESCRIPTION OF THE DRAWINGS

FIG. 1 (B) is a sectional view of the respective metal plates after joining;

FIG. 2 (B) is a perspective view explaining the state of joining between the front panel and the shell;

FIG. 4 (B) is a partial sectional view;

FIG. 6 (*b*) is a plan view exemplifying a projection in the form of a triangular pyramid;

FIG. 7 (*b*) is a sectional view showing the shape of metal plates after burring.

Best Mode for Carrying out the Invention

An embodiment of the present invention will now be described with reference to FIG. 1.

Figure 2A:
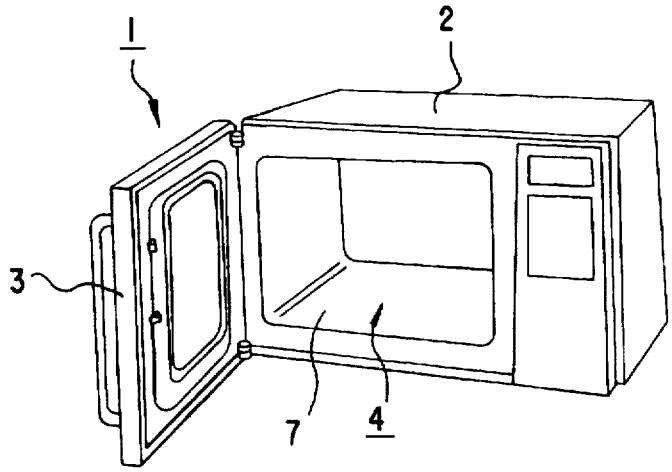
FIG. 2 (A) is a perspective view explaining the general structure of a microwave oven or an oven.
Figure 2B:
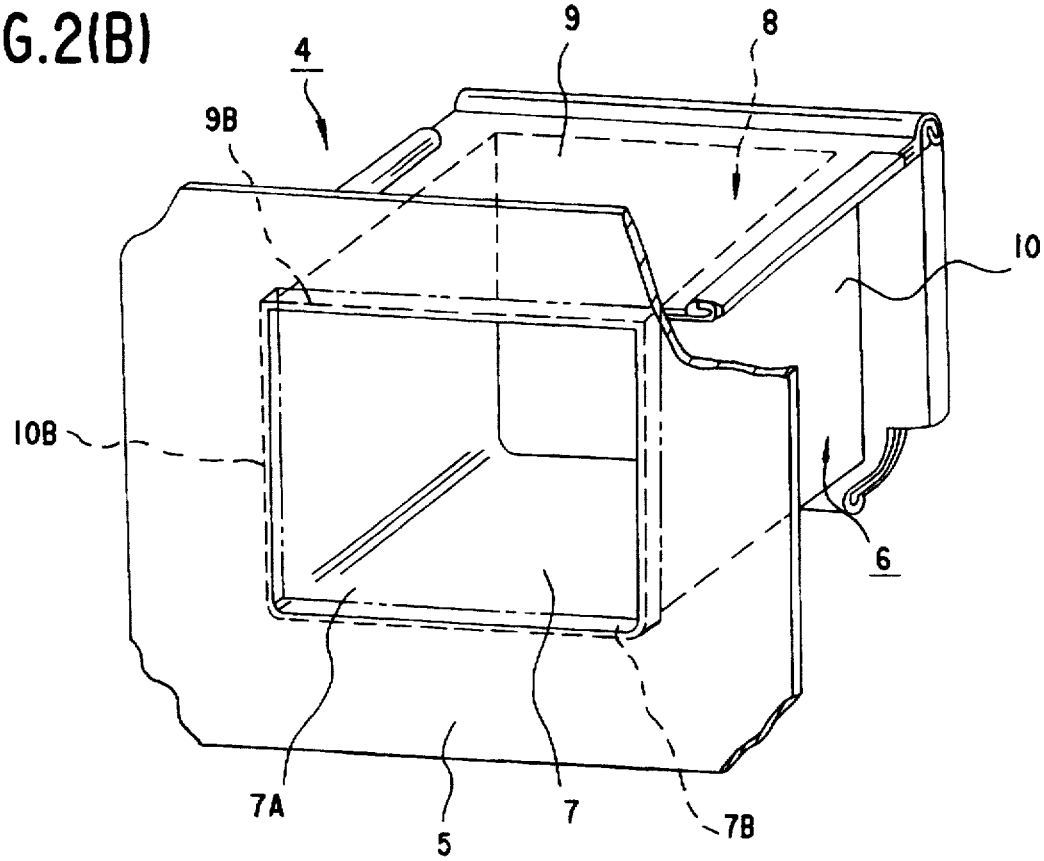

In the paragraphs that follow, explanation will be given by taking for example a case where the present invention is applied to the joining of the inner case of a cooking apparatus described previously in relation to FIG. 2 and FIG. 3, and those elements equivalent to the elements as in the prior art stated earlier will be designated with the same reference numerals while explanation will be omitted on any matters overlapping with the prior art.

Figure 1A:
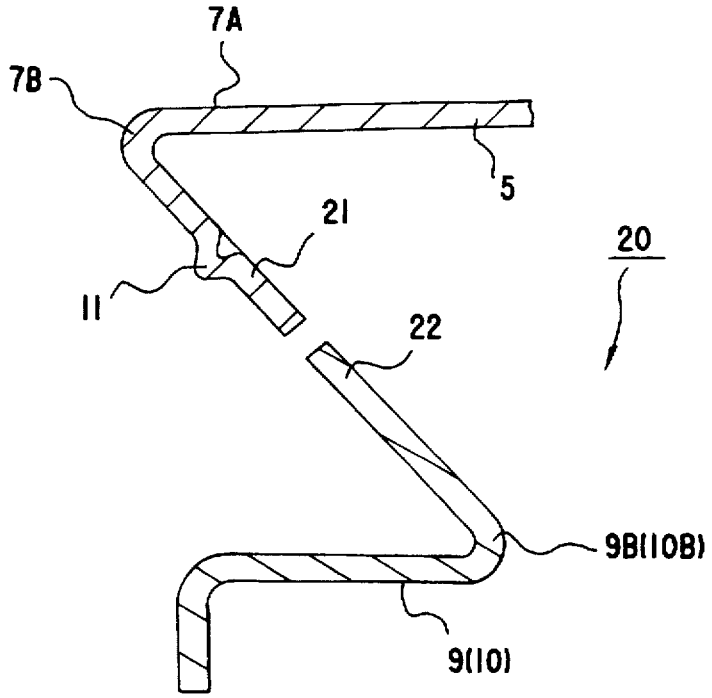
FIG. 1 (A) is a sectional view showing the shape of the respective metal plates before joining.
Figure 1B:
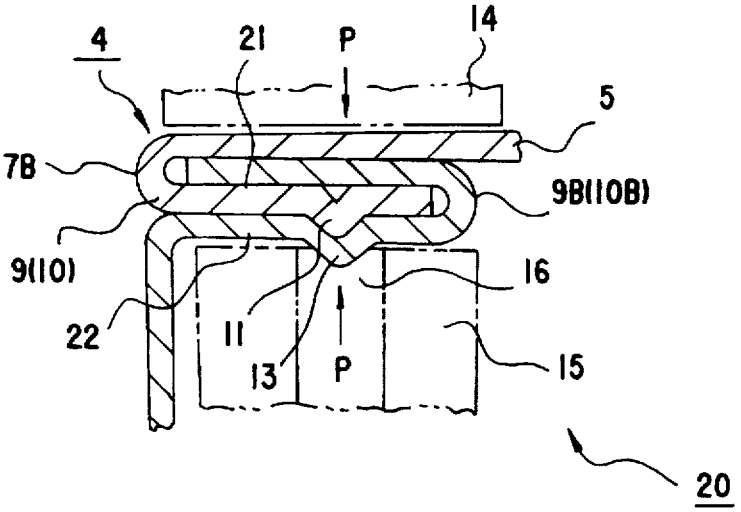

FIG. 1 (A) shows the cross-sectional shape of the metal plates (5, 9, 10) before joining, and FIG. 1 (B) shows the cross-sectional shape of a first metal plate (5) and a second metal plate (9, 10) joined into an integral structure.

As the second metal plate, there is no difference between the metal plate (top plate) (9) and the metal plate (shell plate) (10) as far as the joined part is concerned and, therefore, reference will be made to the metal plate (9) only hereafter.

As shown in FIG. 1 (A), the first metal plate (5) has an edge (21) for joining folded at an acute angle, and projections (11) are provided at prescribed intervals in the longitudinal direction (direction perpendicular to the face of the drawing sheet) on this edge (21). The projections (11) are formed in advance at the edge (21) of the first metal plate (5) prior to the joining process. The second metal plate (9) has an edge (22) for joining folded at an acute angle in the direction opposite to the edge (21) of the first metal plate (5). This edge (22) has the shape of a flat plate.

In the process of joining, the first metal plate (5) and the second metal plate (9) are placed on a lower die (15) in the state where the edge (21) of the first metal plate (5) having projections (11) and the flat edge (22) of the second metal plate (9) are placed one upon the other in opposite directions (see FIG. 1 (B). At this time, positioning is made in such a way that the position of the projections (11) of the first metal plate (5) agrees with the position of the holes (16) provided in the lower die (15).

After the first metal plate (5) and the second metal plate (9) are thus placed and positioned on the lower die (15), the upper die (14) is lowered to apply a load P to the metal plates (5, 9) placed one upon the other from above the first metal plate (5). With the application of the load P, the edges (21, 22) are pressed and bent and at the same time the projections (11) are forcibly advanced into the edge (22) of the counterpart, causing the edge (22) to be plastically deformed according to the shape of the projections (11). At that time, the hole (16) In the lower die (15) receives the portion swollen downward (13) as a result of plastic deformation of the edge (22).

The first and second metal plates (5, 9) joined together present a form as shown In FIG. 1 (B). Because the projections (11) of the edge (21) on one side and the plastically deformed portions (13) of the edge 22 on the other side are engaged closely with each other, any relative displacement of the first and the second metal plates is prevented, providing a joined structure having a joining strength sufficiently large from the practical viewpoint.

Figure 4A:
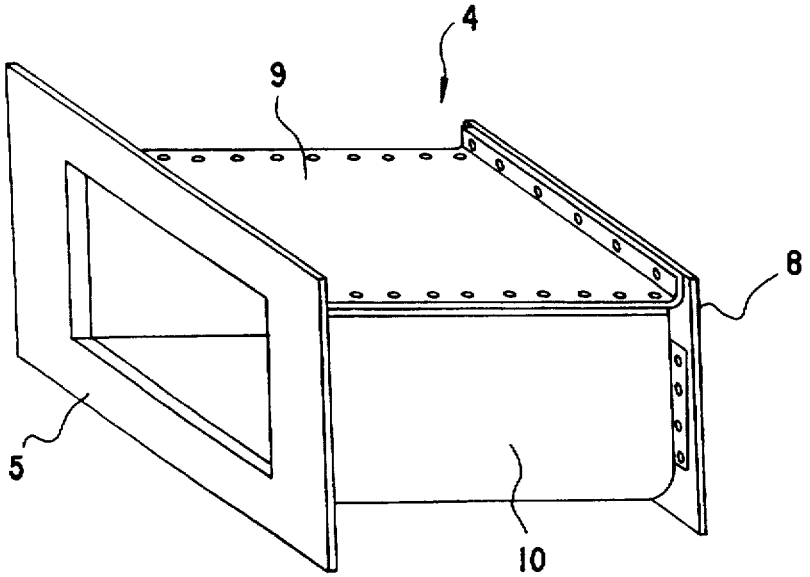
FIG. 4 (A) is a perspective view of the inner case of a cooking apparatus showing an embodiment.
Figure 4B:
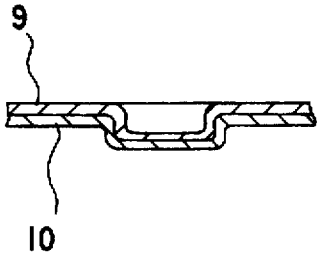

FIG. 4 (A) shows an embodiment in which the present invention is applied to the joining of the inner case of a cooking apparatus. As shown in FIG. 4 (A), the inner case (4) of a cooking apparatus Is constructed with a shell plate (10) with U-shaped section, a front panel (5) joined to the front edge of the shell plate (10), a rear panel (8) joined to the rear edge of the shell plate (10) and a top plate (9) joined to the opening in the upper face of the shell plate (10). The aforementioned joined structure indicated In FIG. 1 is adopted for the joining of the shell plate (10) and the front panel (5) and the joining of the top plate (9) and the front panel (5), while the joined structure as illustrated in FIG. 4 (B) is adopted for the joining of the shell plate (10) and the rear panel (8) and also for the joining of the shell plate (10)

and the top plate (9). The method and apparatus for obtaining the joined structure indicated in FIG. 4 are disclosed by JP-B-60-18259, JP-B-61-18889, JP-AB-2-244533, etc., for example, though they are well known in the art of joining of metal plates.

Although the present invention has been explained based on a concrete embodiment in which it is utilized in the assembling process of the inner case of a cooking apparatus, the present invention must not be interpreted restrictively with the example explained above, but can also be utilized for technical fields other than above. For example, it can also be utilized as means for joining and integrating metal plates having a coating layer and accordingly unfit for welding.

By the way, leakage of electric waves is a problem unique to electronic cooking apparatus such as a microwave oven and no leakage of electric waves should be produced from inside the oven cabinet. For that purpose, electric continuity is necessary at respective joining points of metal plates composing the inner case. Although there is no particular problem about this point in the case of joining of metal plates having no insulating film on the surface, a special measure must be taken in the joining of PCM materials since electrical insulation is produced with the intervention of a paint film between the metallic base materials of the metal plates.

As an example of such measure, the projections (11) are forcibly advanced into the mating metal plate according to the joining method of the present invention as described, and this makes it possible to expect breakage or separation or a insulating film, if any, with the forcible advancement of the projections and, as a result, secure electric continuity between the metal plates (5, 9) in the joined structure thus obtained.

Figure 5A:
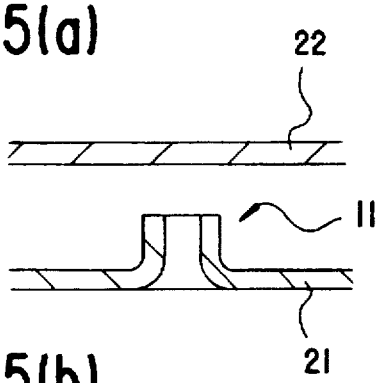
FIG. 5 (*a*) and FIG. 5 (*b*) are sectional views showing an embodiment in which the projections take the form of burring holes.
Figure 5B:
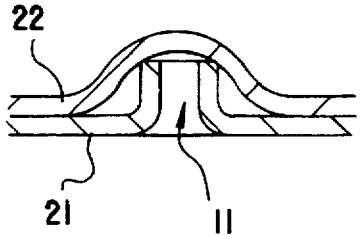

Moreover, it is also possible to obtain better continuity more positively by improving the configuration of the projections (11) as by adopting a particular shape that facilitate breakage of the paint film, etc. of the metal plate (9) when they are forcibly advanced into the edge (22) of the mating metal plate (9). For example, the projections (11) may take the form of burring holes as illustrated in FIG. 5, where it becomes possible to obtain continuity by breaking the paint film of the mating metal plate (9) with the knife edge at the tip of the burring holes.

Figure 6A:
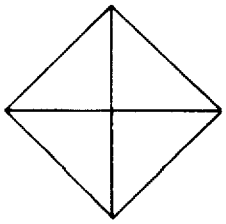
FIG. 6 (*a*) is a plan view exemplifying a projection in the form of a quadrangular pyramid.
Figure 6B:
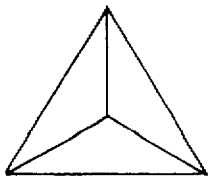
Figure 7A:
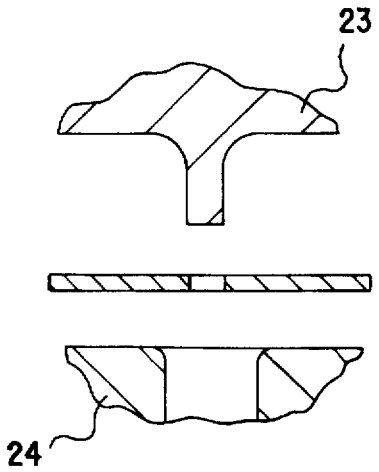
FIG. 7 (*a*) is a sectional view showing the shape of metal plates before burring.
Figure 7B:
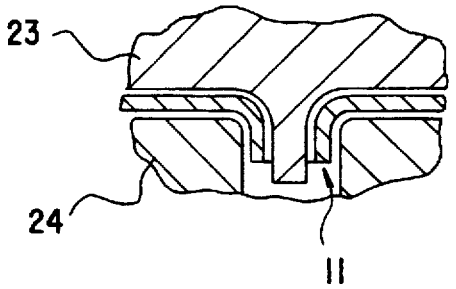

Other solutions are also conceivable such as forming the projections (11) in the form of cones with a pointed end or adopting the form of pyramids with a pointed end as illustrated in FIG. 6, to obtain continuity by breaking the paint film, etc. with the pointed end when the projections (11) are forcibly advanced into the mating metal plate (9).

Figure 8:
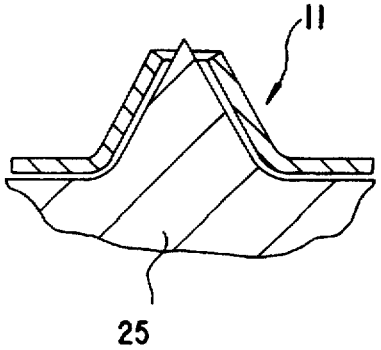
FIG. 8 is a sectional view showing the method of formation of a projection broken at the tip.

There may be cases where it is practically difficult to form projections (11) in the shape of pyramids into metal plates with sharp tip as mentioned above. In such a case, burring holes exposing a knife edge (FIG. 5) are believed to be most effective for breaking the film of the mating metal plate. Burring holes, which are generally intended for tapping, are worked by using burring tools (23, 24) after perforation in metal plates. At that time, by using a tool (25) of conical shape or in the shape of pyramid as shown in FIG. 8 in place of an ordinary burring tool (23), it is possible to form projections exposing edges with broken tip.

As described so far, according to the present invention, the projections provided at the edge of one of the metal plates are forcibly advanced into the edge of the other metal plate by plastically deforming the latter edge and, as a result, those projections and the portion of edge of the other metal plate plastically deformed in the shape of the projections are engaged well with each other to constitute a solid positioning or interlocking means.

Therefore, any relative displacement can be securely prevented in a joined structure realized by joining a first and a second metal plates this way.

Figure 3A:
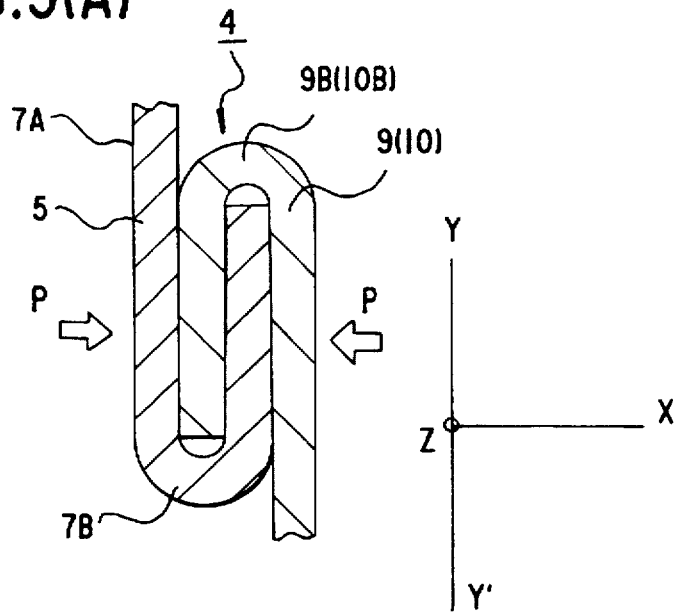
FIG. 3 (A), FIG. 3 (B) and FIG. 3 (C) are sectional views showing prior art.
Figure 3C:
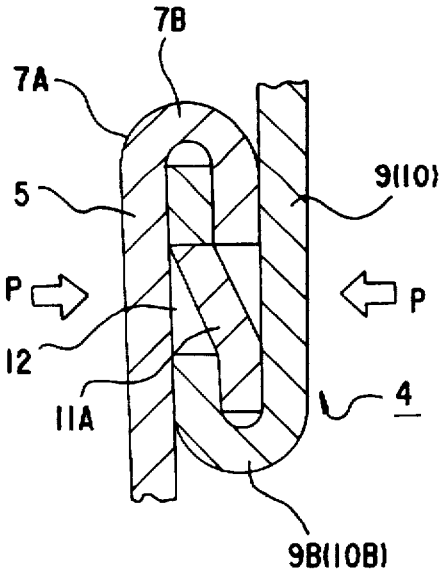
Figure 3B:
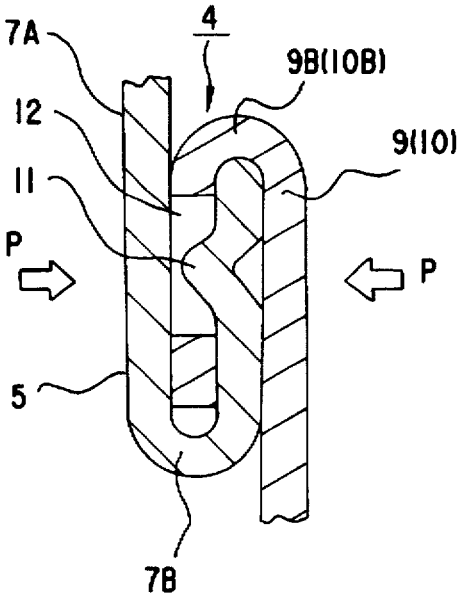

And yet, by forcibly advancing the projections into the edge of the mating metal plate, it not only can do away with holes (see FIG. 3 (B) (C)) for receiving the projections but also facilitates the joining work by completely eliminating the troublesome operation of positioning of the projections or tongues with respect to the associated holes which was hitherto a problem in the prior art. As a result, the dimensional accuracy or the products improves and conspicuous effects, are demonstrated also in the reduction of assembling man-hours of the inner case of a cooking apparatus, etc.

Moreover, even in the case where an insulating film exists on one or both of the mating surfaces of the metal plates, a joined structure securing electric continuity between the joined metal plates can be obtained since the insulating film is broken with the forcible advancement of the projections. Therefore, it is a joined structure advantageous in the case where it is necessary to secure electric continuity between the joined metal plates to prevent leakage of electric waves as in microwave ovens, etc.

I claim:

1. A method of joining metal plates together comprising the steps of:

providing projections at prescribed intervals along a longitudinal direction of one edge of a first metal plate, said projections extending above a first surface of the first plate adjacent said edge, folding a portion of said first metal plate parallel to said edge about a second surface of the plate to a first acute angle to form a crease and a first fold section, said first fold section having said second surface inside said acute angle and said first surface and said projections outside said first acute angle, providing an electrically insulating film to a third surface of a second metal plate, folding a portion of said second metal plate parallel to an edge thereof about the third surface to a second acute angle to form a crease and a second fold section, said second fold section having said third surface inside said second acute angle, engaging said first fold section with said second fold section so as to position said first surface together with said third surface and said projections directly adjacent said insulating film, applying a load to the engaged fold sections to press and bend the creases and forcibly engage said projections into said third surface of the second metal plate plastically deforming the second plate and causing said projections to break through said insulating film to secure electrical continuity between said metal plates.

2. The method for joining metal plates together as defined in claim 1, further comprising supporting said engaged fold sections of the metal plates on a jig having recesses formed therein at positions corresponding to said projections during the step of applying a load to said fold sections.

3. A joined structure of metal plates comprising two metal plates, joined together by the method comprising the steps of:

providing projections at prescribed intervals along a longitudinal direction of one edge of a first metal plate, said projections extending above a first surface of the first plate adjacent said edge, folding a portion of said first metal plate parallel to said edge about a second surface of the plate to a first acute angle to form a crease and a first fold section, said first fold section having said second surface inside said acute angle and said first surface and said projections outside said first acute angle, providing an electrically insulating film to a third surface of a second metal plate, folding a portion of said second metal plate parallel to an edge thereof about the third surface to a second acute angle to form a crease and a second fold section, said second fold section having said third surface inside said second acute angle, engaging said first fold section with said second fold section so as to position said first surface together with said third surface and said projections directly adjacent said insulating film, applying a load to the engaged fold sections to press and bend the creases and forcibly engage said projections into said third surface of the second metal plate plastically deforming the second plate and causing said projections to break through said insulating film to secure electrical continuity between said metal plates.

* * * * *